US012484740B1

(12) United States Patent
Mendes et al.

(10) Patent No.: US 12,484,740 B1
(45) Date of Patent: Dec. 2, 2025

(54) WALL-MOUNTABLE AND LIGATURE-RESISTANT MANUALLY-OPERATED LIQUID/GEL DISPENSER

(71) Applicant: Behavioral Safety Products, LLC, Athens, GA (US)

(72) Inventors: Mark Mendes, Good Hope, GA (US); Cheri Skinner, Watkinsville, GA (US)

(73) Assignee: Behavioral Safety Products, LLC, Athens, GA (US)

( * ) Notice: Subject to any disclaimer, the term of this patent is extended or adjusted under 35 U.S.C. 154(b) by 369 days.

(21) Appl. No.: 18/122,082

(22) Filed: Mar. 15, 2023

(51) Int. Cl.
*A47K 5/12* (2006.01)

(52) U.S. Cl.
CPC ..... *A47K 5/12* (2013.01); *A47K 2201/025* (2013.01)

(58) Field of Classification Search
CPC .. A47K 5/12; A47K 2201/025; A47K 5/1207; A47K 2201/02; A47K 5/1208; A47K 5/1202; A47K 5/13
USPC ..... 222/181.3, 180, 181.1
See application file for complete search history.

(56) References Cited

U.S. PATENT DOCUMENTS

| | | | | |
|---|---|---|---|---|
| 4,667,854 | A | 5/1987 | McDermott et al. | |
| 4,715,517 | A | 12/1987 | Potter et al. | |
| 5,377,871 | A * | 1/1995 | Banks | G01F 11/088 222/101 |
| 5,810,204 | A * | 9/1998 | Devlin | A47K 5/1209 222/88 |
| 9,561,517 | B2 | 2/2017 | Wertheim et al. | |
| 9,585,528 | B2 | 3/2017 | Khamphilapanyo et al. | |
| 9,700,181 | B1 * | 7/2017 | Santoro | B05B 11/1056 |
| 10,123,661 | B2 | 11/2018 | Wertheim et al. | |
| 10,561,282 | B2 | 2/2020 | Miedzius | |
| 10,610,061 | B2 | 4/2020 | Wertheim et al. | |
| 10,743,720 | B2 | 8/2020 | Wertheim | |
| 10,743,721 | B2 | 8/2020 | Wertheim | |
| 11,045,052 | B2 | 6/2021 | Miedzius | |
| 11,278,164 | B2 | 3/2022 | Green et al. | |
| 2019/0191934 | A1 * | 6/2019 | Miedzius | A47K 5/1207 |
| 2022/0175198 | A1 | 6/2022 | Green et al. | |

FOREIGN PATENT DOCUMENTS

| | | | |
|---|---|---|---|
| DE | 102015100201 | A1 | 7/2016 |
| GB | 2601739 | A | 6/2022 |

* cited by examiner

*Primary Examiner* — David P Angwin
*Assistant Examiner* — Christopher S. Parisi
(74) *Attorney, Agent, or Firm* — Mitch Harris, Atty at Law, LLC; Andrew Mitchell Harris

(57) ABSTRACT

A ligature-resistant liquid/gel dispenser includes a rear housing with a mounting plane surface for securing the dispenser to a wall. The dispenser has a front cover is rotatably coupled and lockable to the rear housing and has an aperture for receiving a pushbutton actuator, and a dispenser pump assembly including a reservoir for storing the liquid or gel. The dispenser also includes carriage for activating a vertical pump extension of the dispenser pump assembly, so that vertical movement of the carriage activates the pump. The carriage is mechanically coupled to the pushbutton actuator when the cover is in a closed position, and horizontal movement of the pushbutton actuator is translated into the vertical movement of the carriage. The cover may be secured to the rear housing with a locking mechanism and may have an exterior that is curved or inclined downward from an apex to prevent attachment of a ligature.

16 Claims, 11 Drawing Sheets

WALL-MOUNTABLE AND LIGATURE-RESISTANT MANUALLY-OPERATED LIQUID/GEL DISPENSER

BACKGROUND OF THE INVENTION

1. Field of the Invention

The present invention relates generally to wall-mounted soap dispensers, and in particular, to a wall-mountable and manually-operated liquid/gel dispenser with improved ease of operation through reduced component friction.

2. Description of the Related Art

Ligature-resistant design is a requirement in many institutional locations. In particular, in rooms where persons may be left unattended and where there is a risk that fixtures may be used as a support to tie a ligature, such as a belt, rope or a cloth, a way to ensure that the fixtures cannot be used in such a manner is desirable. In general, ligature-resistant design is an issue that exists any height above the floor, since objects above the floor can be used to support a ligature, even if one is not attachable.

Wall-mounted liquid/gel dispensers are in common-use in public places and private facilities such as hospitals, mental health facilities and incarceration facilities. In such private facilities it is desirable to provide soap, hand sanitizer and hand lotion for convenience and sanitation, as in public facilities. Commercial soap are not generally suitable ligature-resistant designs and typically provide an activation lever around which a ligature can be attached and a shape around which a ligature may be formed by looping around the dispenser. In order to remove the lever, a pushbutton that conforms to the outside of the housing may be used, but such dispensers are generally electrically operated, as the amount of force required to activate a liquid pump is typically relatively great. Electrically operated dispensers require replacement of batteries or require a separate electrical supply, such as connections to building wiring, which is generally undesirable.

Therefore, it would be desirable to provide a manually-operated liquid/gel dispenser that prevents ligature formation and/or support of such ligatures. It would further be desirable to provide such a manually-operated liquid/gel dispenser with reduced activation force.

SUMMARY OF THE INVENTION

The above objectives, among others, are achieved in a ligature-resistant mechanically-operated liquid/gel dispenser and a method of dispensing gels/liquids.

The liquid/gel dispenser includes a rear housing having a mounting plane surface on a rear face thereof for securing the liquid/gel dispenser to a wall and a front cover rotatably coupled to the rear housing and which defines an aperture through the front cover for receiving a pushbutton actuator. The liquid/gel dispenser also includes a dispenser pump assembly including a reservoir for storing the liquid or gel, and a carriage for activating a vertical pump extension of the dispenser pump assembly, so that vertical movement of the carriage activates a pump mechanism of the dispenser pump assembly. The carriage is mechanically coupled to the pushbutton actuator when the front cover is in a closed position, so that horizontal movement of the pushbutton actuator is translated into the vertical movement of the carriage. The liquid/gel dispenser also includes a locking mechanism for securing the front cover to the rear housing.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure illustrates mechanically-operated liquid/gel dispensers that may provide ligature-resistant structure and installation. The liquid/gel dispensers may have a front cover that covers a wall-mountable rear housing that holds the dispenser pump mechanism and reservoir. The front cover may be rotatably coupled to the rear housing and may define an aperture through the front cover for receiving a putton actuator. The liquid/gel dispenser may also include a dispenser pump assembly including a reservoir for storing the liquid or gel, and a carriage for activating a vertical pump extension of the dispenser pump assembly, so that vertical movement of the carriage activates a pump mechanism of the dispenser pump assembly. The carriage may be mechanically coupled to the pushbutton actuator when the front cover is in a closed position, so that horizontal movement of the pushbutton actuator is translated into the vertical movement of the carriage. The liquid/gel dispenser may also include a locking mechanism for securing the front cover to the rear housing. The types of liquids or gels dispensed will generally be soaps, hand lotions and hand sanitizer, but the particular application is not a limitation of the present disclosure. The illustrated example is an assembly of molded plastic parts, although though the embodiments disclosed herein are not limited as to materials or techniques of fabrication.

Figure 1:
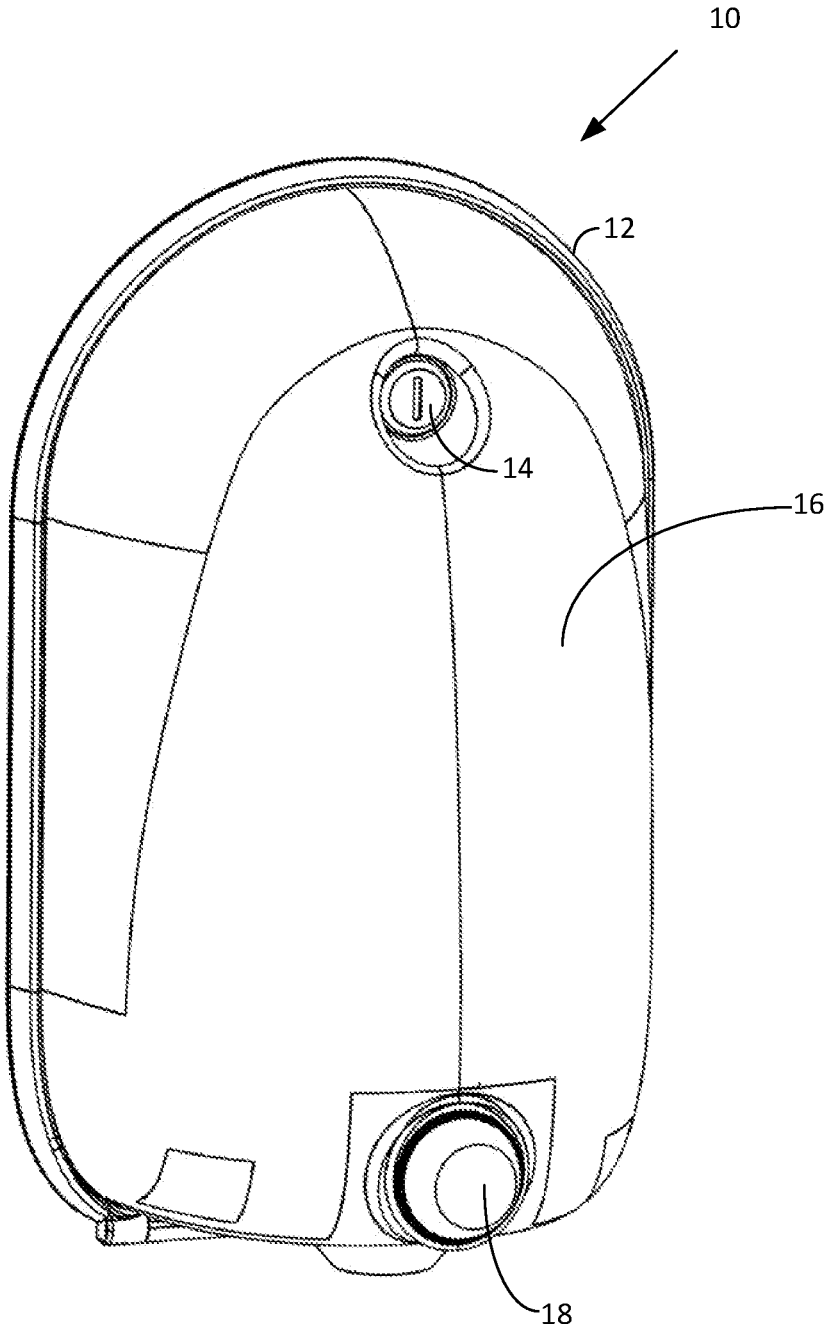
FIG. 1 is an upper left front perspective view of an example ligature-resistant liquid/gel dispenser 10, in accordance with an embodiment of the disclosure.

Referring now to FIG. 1, an upper left front perspective view of an example ligature-resistant liquid/gel dispenser 10 is shown, in accordance with an embodiment of the disclosure. Example ligature-resistant liquid/gel dispenser 10 includes a rear housing 12 for mounting to a wall, and a front cover 16 that is secured over the rear housing 12 to enclose a liquid/gel reservoir and pump mechanism. A keylock 14 provides for securing front cover 16 in the closed position, and a pushbutton actuator 18 is provided to dispense the liquid or gel when pressed to activate a pump mechanism within example ligature-resistant liquid/gel dispenser 10.

Figure 2:
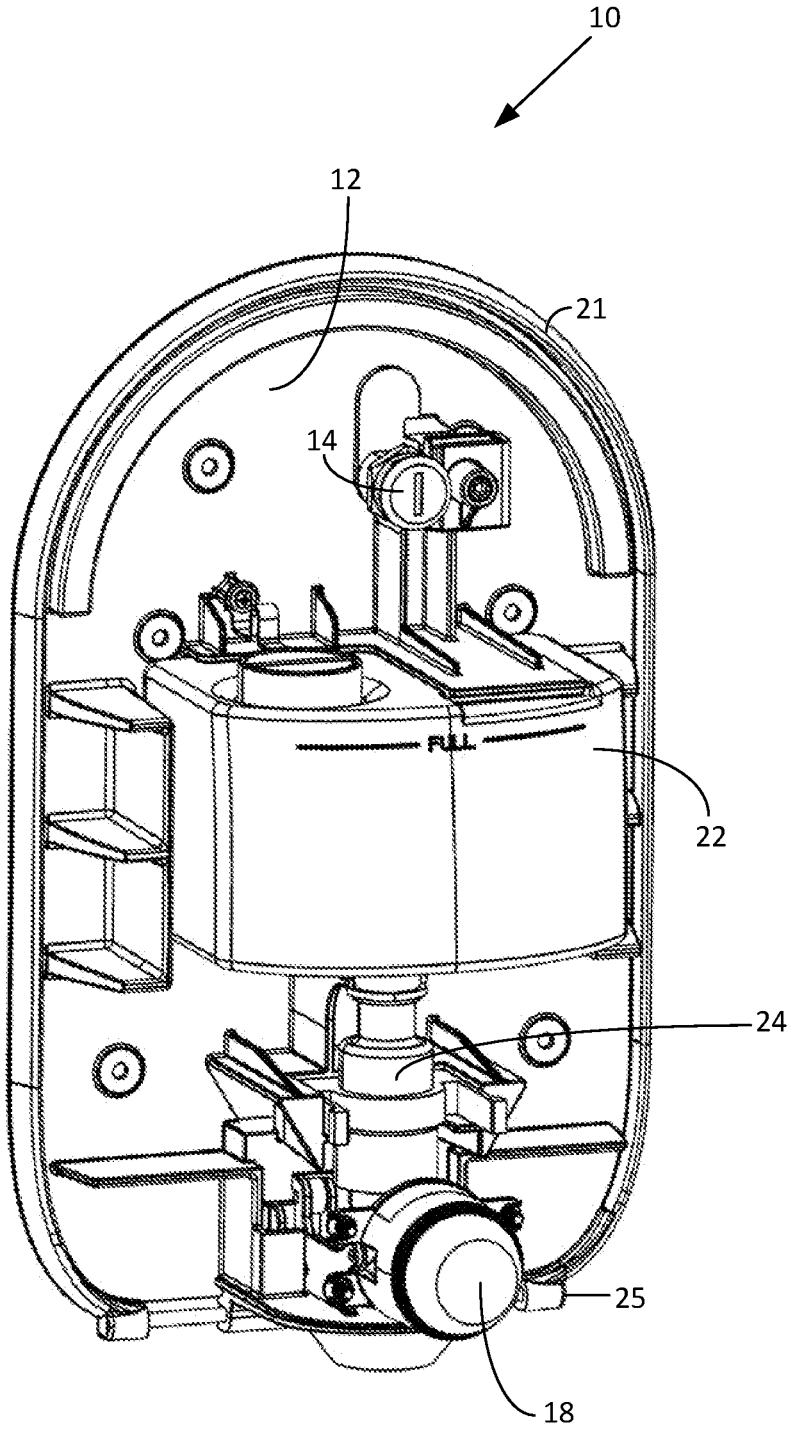
FIG. 2 is an upper left front perspective view of example ligature-resistant liquid/gel dispenser 10, with front cover 16 removed, in accordance with an embodiment of the disclosure.

Referring now to FIG. 2, an upper left front perspective view of example ligature-resistant liquid/gel dispenser 10 is shown, with front cover 16 removed, in accordance with an embodiment of the disclosure. A reservoir 22 stores a liquid or gels for dispensing via a pump mechanism 24, both of which are installed in retaining features provided on an inside front surface of rear housing 12. A raised lip 21 surrounds rear housing 12 around a top and sides of rear housing 12 and extending down to a hinge 25 that rotatably couples front cover 16 (not shown) to rear housing 12. Raised lip 21 hides the rear edge of front cover 16 when front cover 16 is secured to rear housing 12 by keylock 14, providing a blind seam that prevents insertion of a ligature between front cover 16 and rear housing 12.

Figure 3:
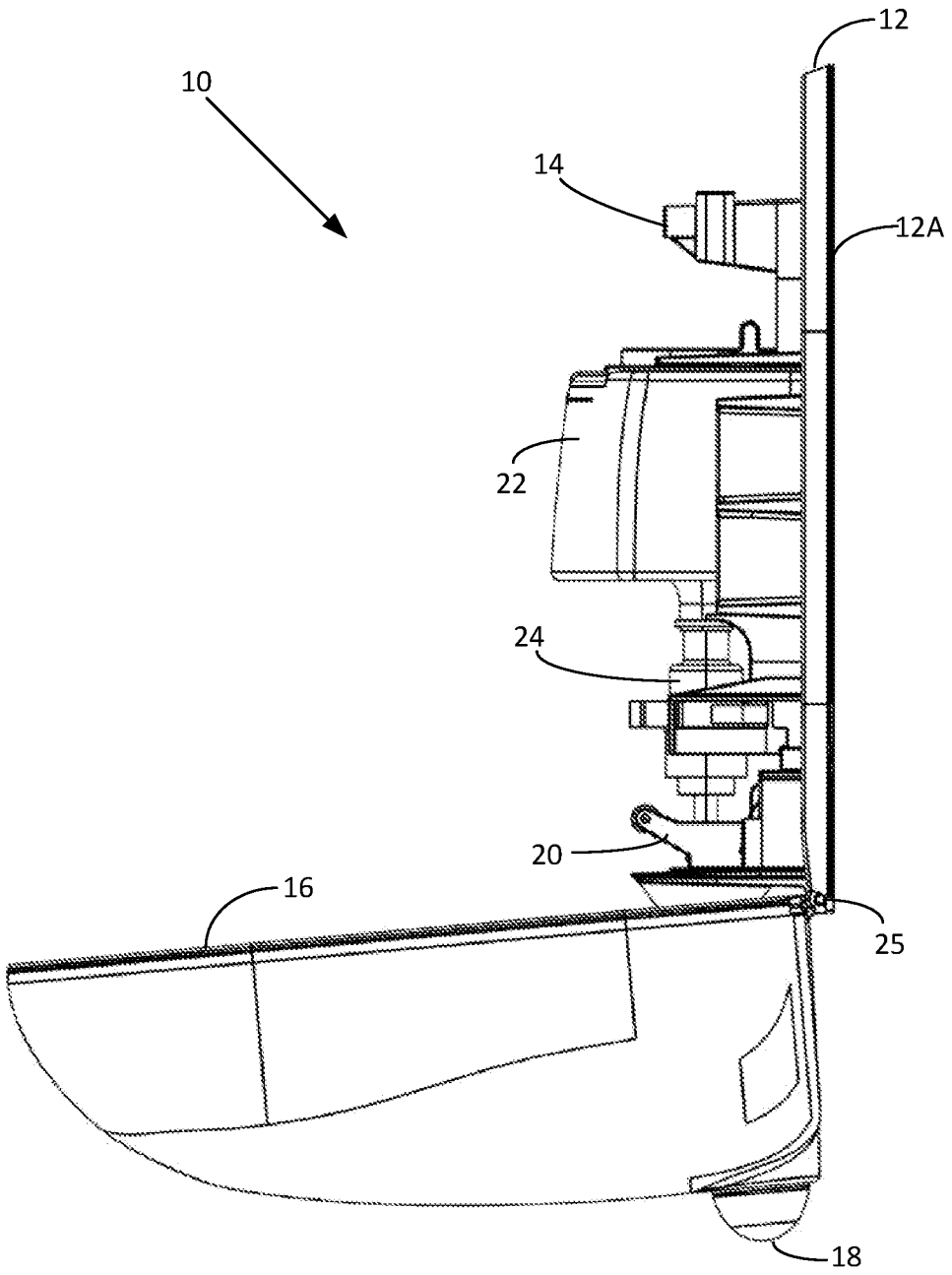
FIG. 3 is a right side view of example ligature-resistant liquid/gel dispenser 10, with front cover 16 opened, in accordance with an embodiment of the disclosure.

Referring now to FIG. 3, a right side view of example ligature-resistant liquid/gel dispenser 10 is shown, with front cover 16 opened, in accordance with an embodiment of the disclosure. To open ligature-resistant liquid/gel dispenser 10, keylock 14 is set to an unlocked position with a key and front cover 16 is rotated downward via hinge 25. A carriage 20 is illustrated that is activated by depressing pushbutton actuator 18, while front cover 16 is secured in the closed position by keylock 14. Depressing pushbutton actuator 18 raises carriage 20 vertically, to activate pumping mechanism 24 to dispense liquid or gel from reservoir 22. A planar rear mounting surface 12A is provided by the rear face of rear housing 12 for mounting example ligature-resistant liquid/gel dispenser 10 to a wall, partition, or other suitable flat mounting surface.

Figure 4:
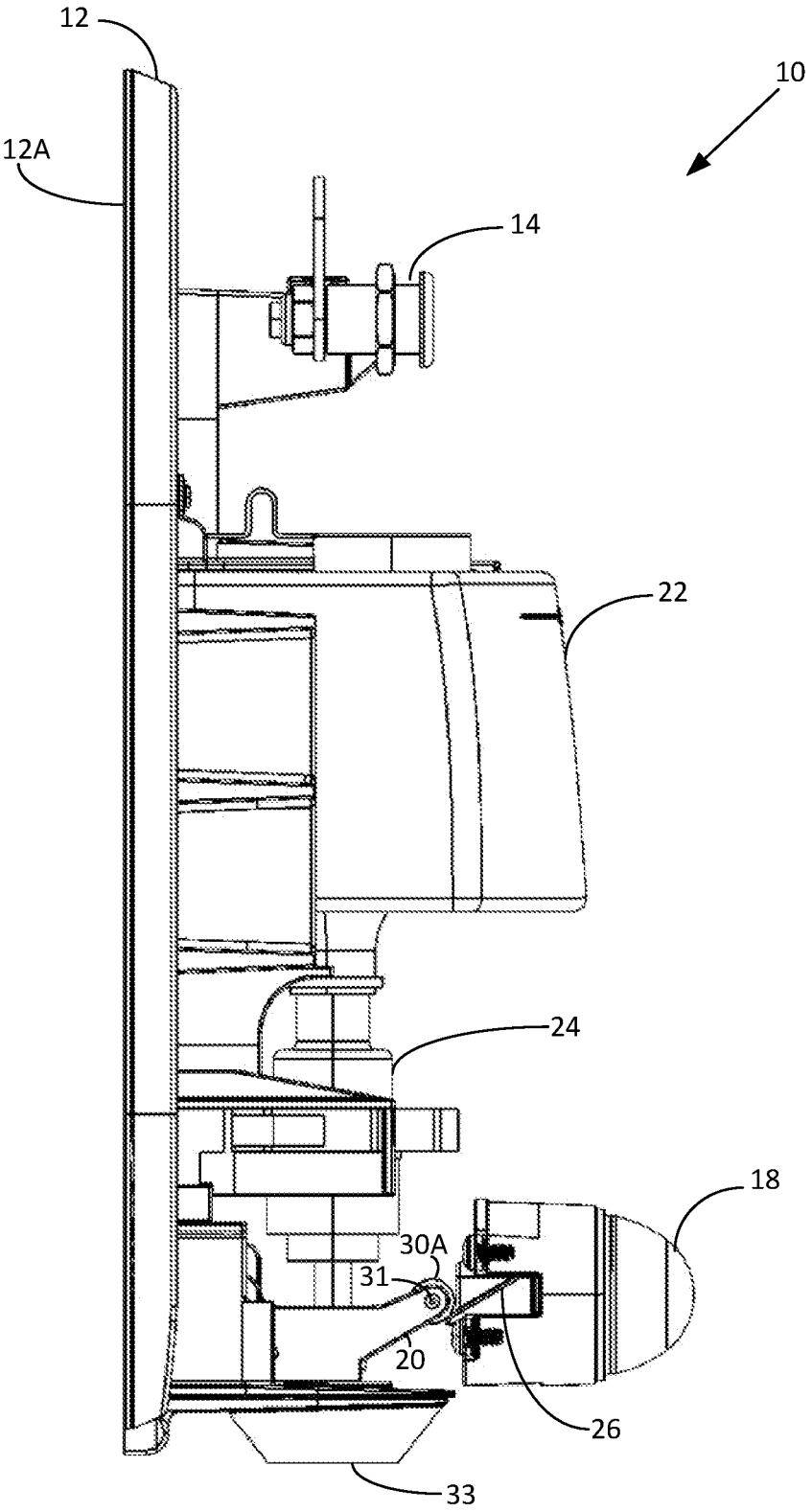
FIG. 4 is a left side view of example ligature-resistant liquid/gel dispenser 10, with cover 16 removed, in accordance with an embodiment of the disclosure.

Referring now to FIG. 4, a left side view of example ligature-resistant liquid/gel dispenser 10 is shown, with cover 16 removed, in accordance with an embodiment of the disclosure. A pair of ramps 26, i.e., inclined surfaces, are provided along an inner portion of pushbutton actuator 18, which contact a corresponding pair of wheels 30A that are provided at the front upper extension of carriage 20, and secured thereto by a corresponding pair of axles 31. An outlet 33 provides an aperture for ejecting liquid or gel when carriage 20 is raised to activate pumping mechanism 24.

Figure 5:
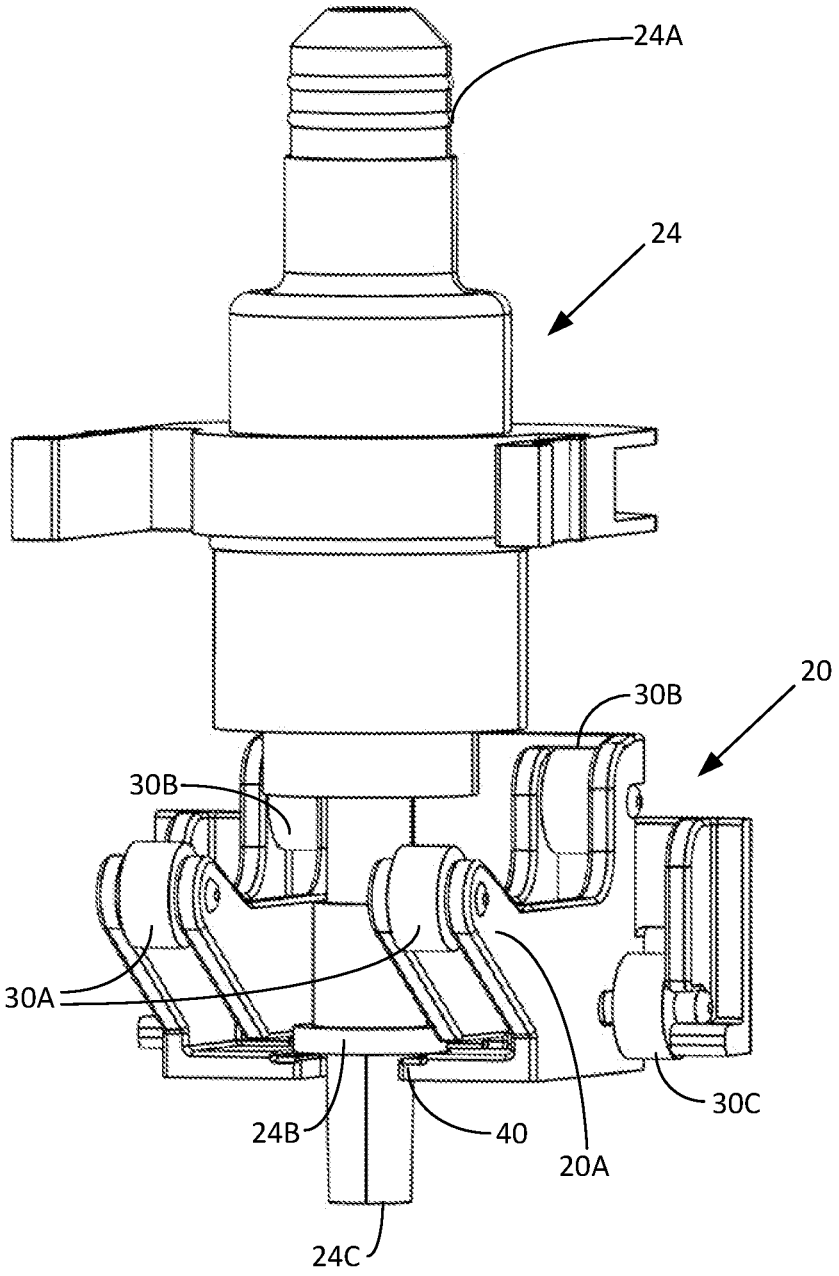
FIG. 5 is an upper right front perspective view showing details of an example carriage 20 and dispensing end 24C of example ligature-resistant liquid/gel dispenser 10 of FIGS. 1-4, in accordance with an embodiment of the disclosure.

Referring now to FIG. 5, an upper right front perspective view showing details of example carriage 20 and pump mechanism 24 of example ligature-resistant liquid/gel dispenser 10 of FIGS. 1-4 is shown, in accordance with an embodiment of the disclosure. Pump mechanism 24 includes a reservoir fitting 24A that is inserted into a connection of reservoir 22 (not shown) when ligature-resistant liquid/gel dispenser 10 is in use. An open collar 40 provided in carriage 20 raises a flange 24B provided around a lower movable dispensing end 24C of pump mechanism 24, through which the liquid or gel is dispensed when dispensing end 24C is moved upward. Dispensing end 24C is in fluid communication with outlet 33 (not shown) when front cover 16 (not shown) is secured over rear housing 12 (not shown). Rollers 30A are provided at the ends of a pair of frontward and upward extensions 20A of carriage 20, and additional upper rear wheels-30B and lower rear wheels 30C are provided to roll along surfaces of structures formed on rear housing (not shown) and to restrain carriage 20 against rotation so that carriage 20 only moves vertically when pushbutton actuator 18 (not shown) is depressed, as will be described in further detail below.

Figure 6A:
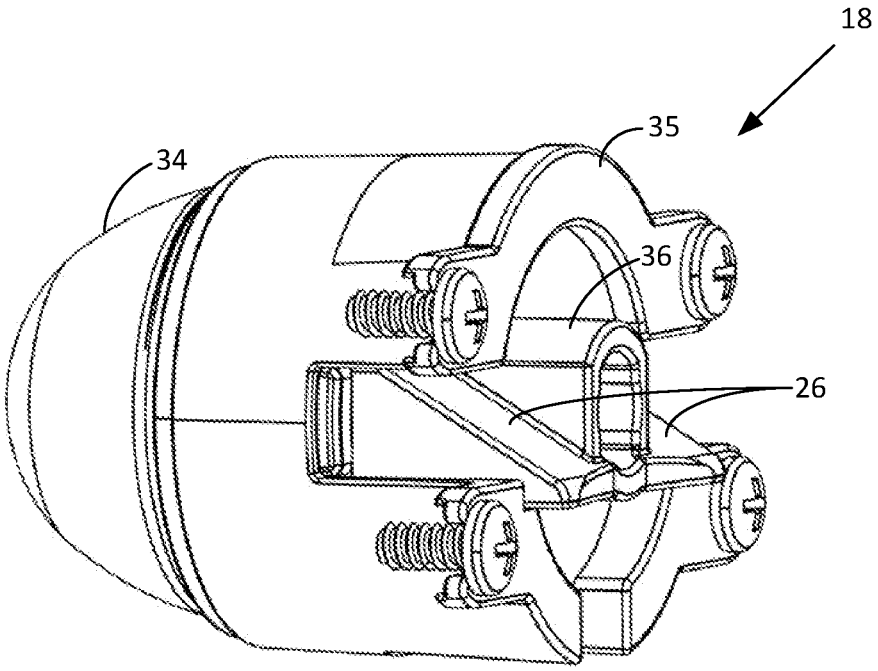
FIG. 6A is a right rear perspective view and FIG. 6B is an exploded right side rear perspective view of example pushbutton actuator 18 of ligature-resistant liquid/gel dispenser 10 of FIGS. 1-4, in accordance with an embodiment of the disclosure.
Figure 6B:
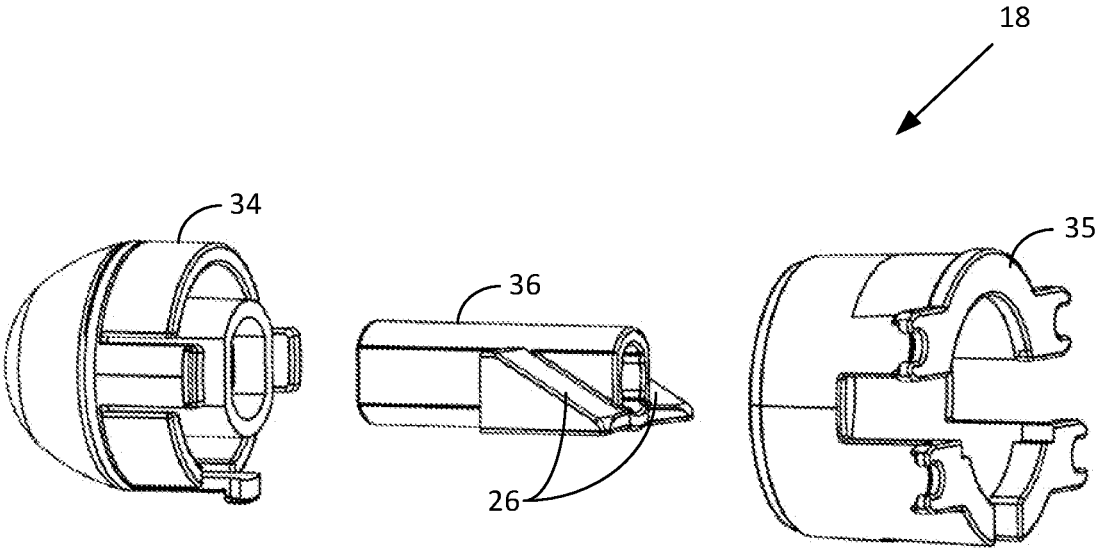

Referring now to FIG. 6A and FIG. 6B, a right rear perspective view and an exploded left side rear perspective view of example pushbutton actuator 18 of ligature-resistant liquid/gel dispenser 10 of FIGS. 1-4 are shown, respectively, in accordance with an embodiment of the disclosure. Ramps 26 are visible in FIG. 6A and may be provided by a central actuator arm 36 that may be secured to button portion 34 of pushbutton actuator 18 by a rear retaining sleeve 35, as shown in FIG. 6B. Rear retaining sleeve may be fastened to button portion 34 by fasteners (not shown for clarity of illustration), by gluing, or pushbutton actuator 18 may be formed as a single molded unit.

Figure 7A:
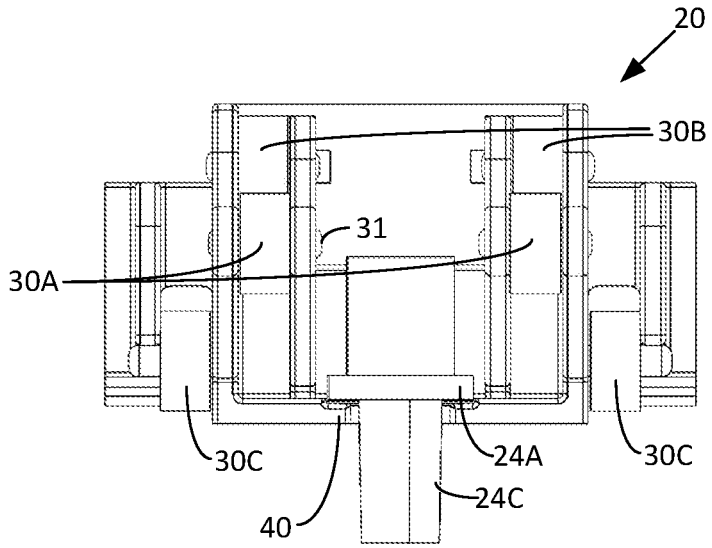
FIG. 7A is a front view and FIG. 7B is a bottom view of example carriage 20 and pump actuator dispensing end 24A of example ligature-resistant liquid/gel dispenser 10 of FIGS. 1-4, in accordance with an embodiment of the disclosure.
Figure 7B:
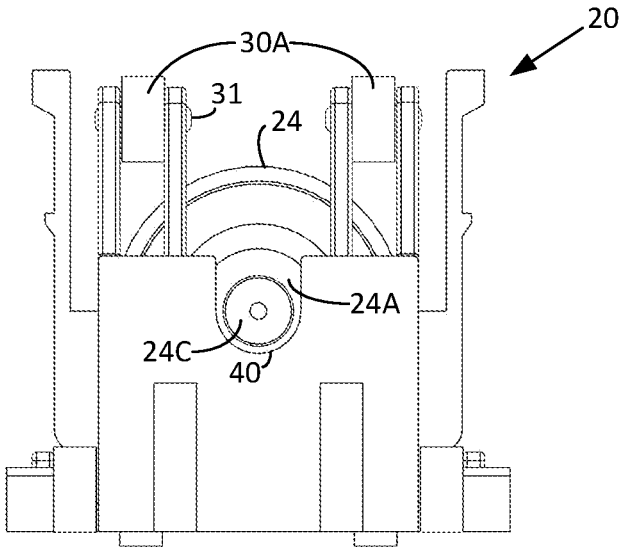

Referring now to FIG. 7A and FIG. 7B, a front view and a bottom view of example carriage 20 and dispensing end 24C of example ligature-resistant liquid/gel dispenser 10 of FIGS. 1-4 are shown, respectively, in accordance with an embodiment of the disclosure. In FIG. 7A and FIG. 7B, a position of open collar 40 around and beneath flange 24A of pump mechanism 24 is visible, as well as the passage of dispensing end 24C therethrough. The structure of rollers 30A and their corresponding axles 31 are also shown. The relative vertical positions of upper rear rollers 30B and lower rear wheels 30C are also shown in FIG. 7A.

Figure 8A:
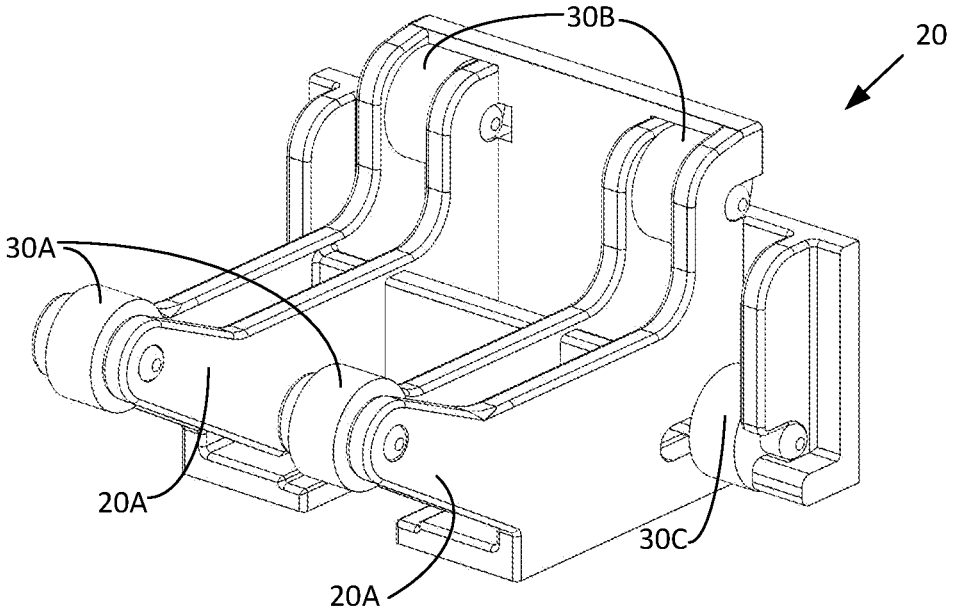
FIG. 8A is a right front perspective view and FIG. 8B is an exploded left front perspective view of example carriage 12 of ligature-resistant liquid/gel dispenser 10 of FIGS. 1-4, in accordance with an embodiment of the disclosure.
Figure 8B:
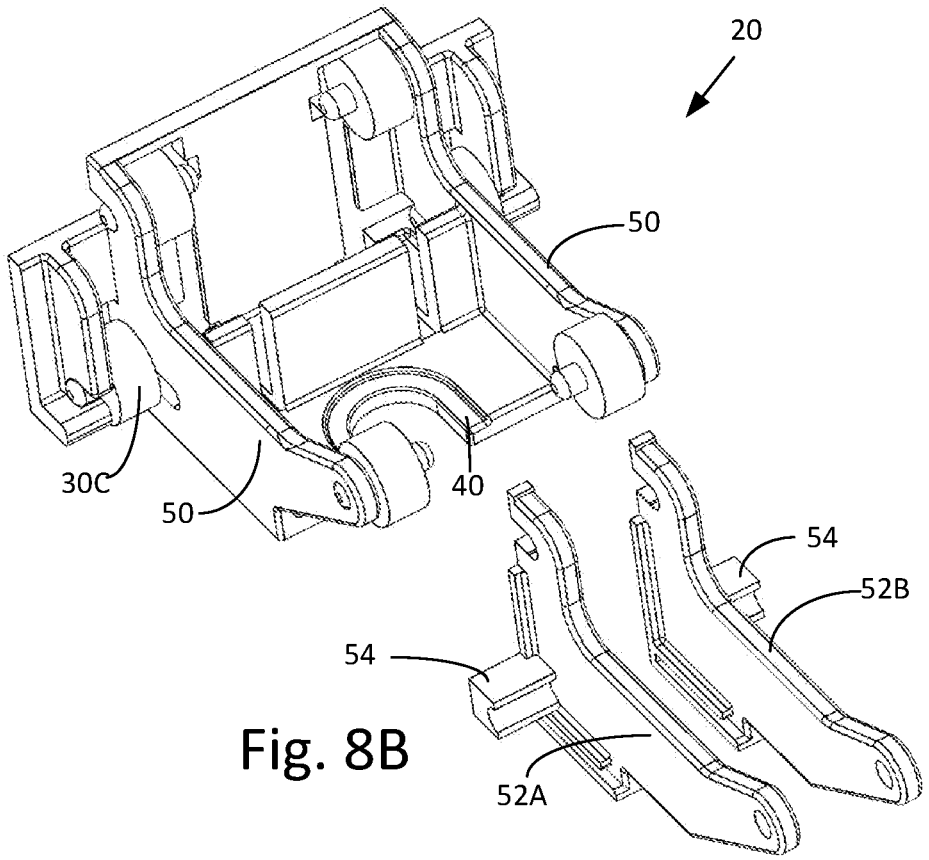

Referring now to FIG. 8A and FIG. 8B, a right front perspective view and an exploded left front perspective view of example carriage 20 of ligature-resistant liquid/gel dispenser 10 of FIGS. 1-4 are shown, respectively, in accordance with an embodiment of the disclosure. As shown in FIG. 8B, carriage 20 may be assembled from a base portion 50 into which a pair of inner arm portions 52A, 52B are inserted, which may be snap-fit, or glued. Inner arm portions 52A,52B provide a pair of half-bearings 54 for rotatably capturing axles 31 of lower rear wheels 30C to base portion 50.

Figure 9:
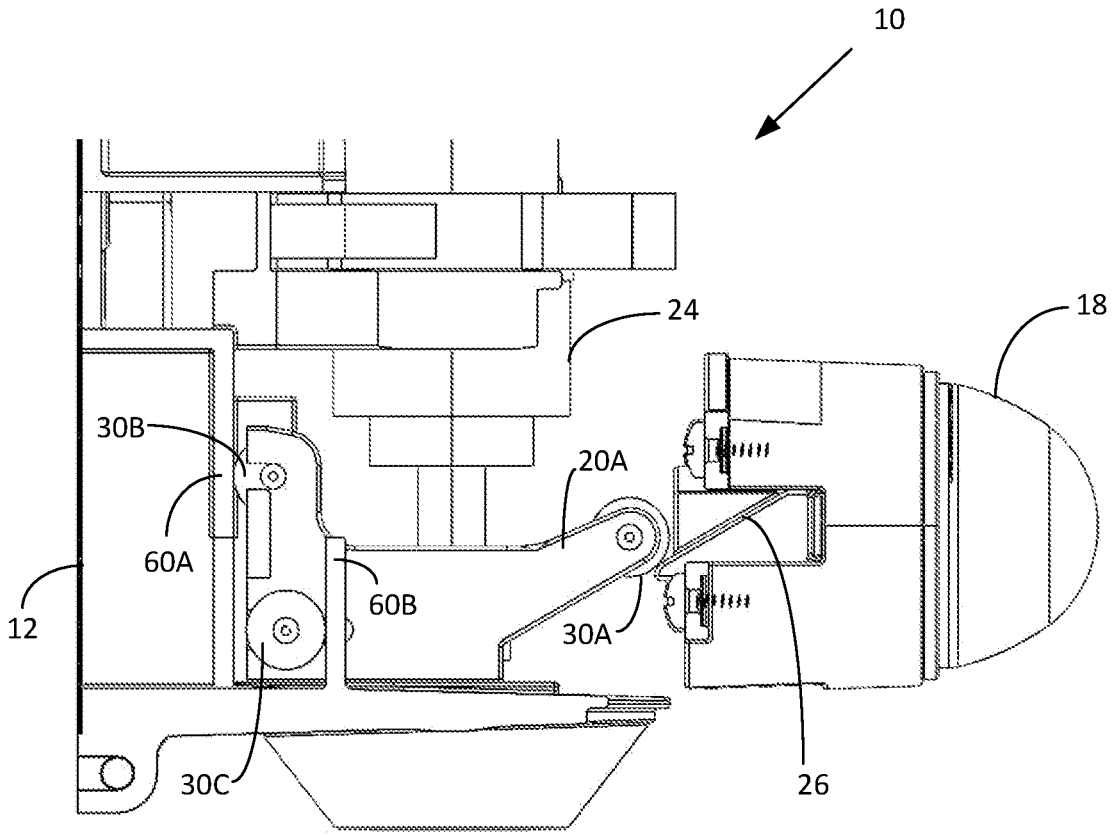
FIG. 9 is a partial sectional view of internal components of example ligature-resistant liquid/gel dispenser 10, in accordance with an embodiment of the disclosure.

Referring now to FIG. 9, a partial sectional view of internal components of example ligature-resistant liquid/gel dispenser 10 is shown, in accordance with an embodiment of the disclosure. A position of ramps 26 with relation to rollers 30A at the front upper and of forward and upward extensions 20A of carriage 20 is visible and corresponds to a position of pushbutton actuator 18 when pushbutton actuator is not depressed. Lower rear wheels 30C contact a projection 60B of rear housing 12 that extends in front of lower rear wheels 30C, while upper rear wheels 30B contact a section 60A of a front surface of rear housing 12. Contact of lower rear wheels 30C along projection 60B and contact of upper rear wheels 30B with section 60A restrain carriage 20 against rotation when pushbutton actuator 18 is depressed and wheels 30A roll along ramps 26 of pushbutton actuator 18.

Figure 10A:
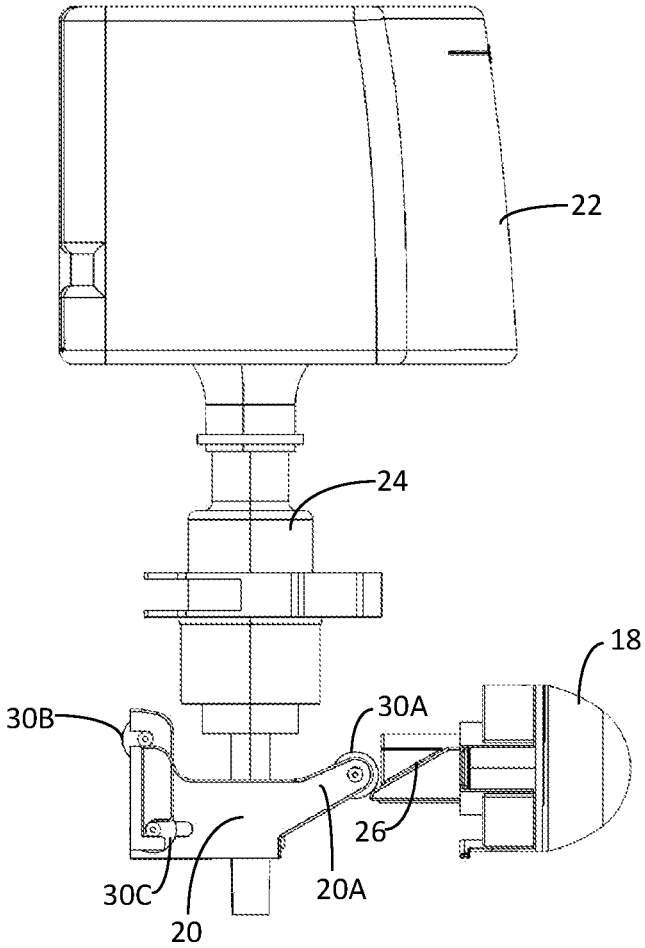
FIG. 10A and FIG. 10B are side views of internal components of example ligature-resistant liquid/gel dispenser 10 while dispensing liquid/gel, in accordance with an embodiment of the disclosure.
Figure 10B:
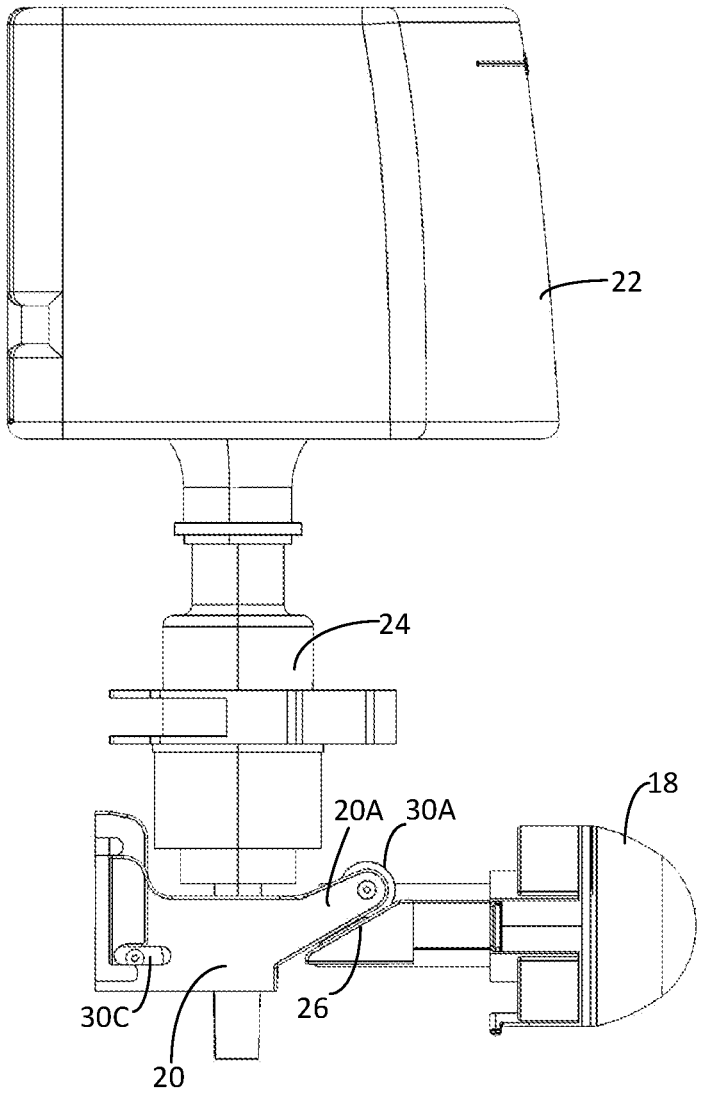

Referring now to FIG. 10A and FIG. 10B, side views of internal components of example ligature-resistant liquid/gel dispenser 10 are shown while dispensing liquid/gel, in accordance with an embodiment of the disclosure. FIG. 10A shows the same non-depressed position of pushbutton 18, with rollers 30A just contacting the rear edge of ramps 26 and with carriage 20 in a lowered position. FIG. 10B shows a position of pushbutton 18 when depressed, with rollers 30A at an upper end of ramps 26 and carriage 20 is in a raised position, which activates pump mechanism 24.

In summary, this disclosure shows and describes liquid/gel dispensers for dispensing liquid/gel soap and/or other liquids and gels. The ligature-resistant soap dispensers may include a rear housing having a mounting plane surface on a rear face thereof for securing the liquid/gel dispenser to a wall, a front cover rotatably coupled to the rear housing, the front cover defining an aperture therethrough for receiving a pushbutton actuator, a dispenser pump assembly including a reservoir for storing the liquid or gel, and a carriage for activating a vertical pump extension of the dispenser pump assembly, so that vertical movement of the carriage activates a pump mechanism of the dispenser pump assembly. The carriage may be mechanically coupled to the pushbutton actuator when the front cover is in a closed position, so that horizontal movement of the pushbutton actuator is translated into the vertical movement of the carriage, and the liquid/gel dispenser may include a locking mechanism for securing the front cover to the rear housing.

In some example embodiments, the carriage may define an open collar for accepting the vertical pump extension of the dispenser pump assembly while permitting removal of the dispenser pump assembly for maintenance. In some example embodiments, the front cover may have an exterior that is curved or inclined downward from an apex to prevent attachment of a ligature, and the rear housing and front cover may join at a blind seam extending around the apex of the top projection and along both sides of the rear housing to prevent insertion of a ligature. In some example embodiments, the pushbutton may include at least one inclined ramp, and wherein the carriage may include at least one corresponding forward and upward extension inclined to extend along the at least one inclined ramp, so that when the pushbutton actuator is depressed, the at least one ramp moves the corresponding forward and upward extension upward to raise the carriage and activate the pump mechanism.

In some example embodiments, the carriage may further include one or more wheels each rotationally coupled to a distal end of a corresponding one of the one or more forward and upward extension of the carriage, so that the one or more wheels roll along a corresponding one of the at least one inclined ramp when the pushbutton actuator is activated.

In some example embodiments, the carriage may further include one or more rear wheels rotationally coupled to the carriage at a rear of the carriage, wherein the one or more rear wheels roll upward along an inside surface of the rear housing as the carriage is driven upward by activation of the pushbutton actuator. In some example embodiments the at least one ramp may be a pair of ramps disposed on either side of a central rear projection within the pushbutton actuator, and the at least one forward and upward extension of the carriage may include two corresponding pairs of extensions. In some example embodiments, each of the pairs of extensions may surround a corresponding wheel secured and rotationally coupled to the pair of extensions at a distal end thereof by an axle. and the wheels may be secured to each of the pairs of extensions roll along a corresponding one of the pair of ramps when the pushbutton actuator is activated.

In some example embodiments, the carriage may further include a pair of rear wheels rotationally coupled to the carriage at a rear of the carriage, so that the pair of rear wheels roll upward along an inside surface of the rear housing as the carriage is driven upward by activation of the pushbutton actuator. In some example embodiments, the pair of rear wheels may be a first pair of rear wheels located proximate a top of the rear of the carriage, and the carriage may further include a second pair of rear wheels rotationally coupled to the carriage near a bottom of the carriage and displaced forward from the first pair of rear wheels. The second pair of rear wheels may roll upward along a projection of the rear housing extending in front of the second pair of rear wheels as the carriage is driven upward by activation of the pushbutton actuator, ao that the first pair of rear wheels and the second pair of rear wheels further secure the carriage against rotation when the pushbutton actuator is activated.

It should be understood, especially by those having ordinary skill in the art with the benefit of this disclosure, that the various operations described herein, particularly in connection with the figures, may be implemented by other components. The order in which each operation of a given method is performed may be changed, and various elements of the devices and systems illustrated herein may be added, reordered, combined, omitted, modified, etc. It is intended that this disclosure embrace all such modifications and changes and, accordingly, the above description should be regarded in an illustrative rather than a restrictive sense. Similarly, although this disclosure makes reference to specific embodiments, certain modifications and changes may be made to those embodiments without departing from the scope and coverage of this disclosure. Moreover, any benefits, advantages, or solutions to problems that are described herein with regard to specific embodiments are not intended to be construed as a critical, required, or essential feature or element.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A ligature-resistant liquid/gel dispenser for dispensing a liquid or gel comprising:

a rear housing having a mounting plane surface on a rear face thereof for securing the liquid/gel dispenser to a wall;

a front cover rotatably coupled to the rear housing, the front cover defining an aperture therethrough for receiving a pushbutton actuator;

a dispenser pump assembly including a reservoir for storing the liquid or gel;

a carriage for activating a vertical pump extension of the dispenser pump assembly, whereby vertical movement of the carriage activates a pump mechanism of the dispenser pump assembly, wherein the carriage is mechanically coupled to the pushbutton actuator when the front cover is in a closed position, and wherein horizontal movement of the pushbutton actuator is translated into the vertical movement of the carriage, wherein the pushbutton actuator includes at least one inclined ramp, wherein the carriage includes at least one corresponding forward and upward extension inclined to extend along the at least one inclined ramp, so that when the pushbutton actuator is depressed, the at least one ramp moves the corresponding forward and upward extension upward to raise the carriage and activate the pump mechanism, wherein the carriage further comprises one or more wheels each rotationally coupled to a distal end of a corresponding one of the one or more forward and upward extension of the carriage, wherein the one or more wheels roll along a corresponding one of the at least one inclined ramp when the pushbutton actuator is activated; and a locking mechanism for securing the front cover to the rear housing.

2. The ligature-resistant liquid/gel dispenser of claim 1, wherein the carriage defines an open collar for accepting the vertical pump extension of the dispenser pump assembly while permitting removal of the dispenser pump assembly for maintenance.

3. The ligature-resistant liquid/gel dispenser of claim 1, wherein the front cover has an exterior that is curved or inclined downward from an apex to prevent attachment of a ligature.

4. The ligature-resistant liquid/gel dispenser of claim 3, wherein the front cover and the rear housing join at a blind seam extending around the apex of the top projection and along both sides of the rear housing to prevent insertion of a ligature.

5. The ligature-resistant liquid/gel dispenser of claim 1, wherein the carriage further comprises one or more rear wheels rotationally coupled to the carriage at a rear of the carriage, wherein the one or more rear wheels roll upward along an inside surface of the rear housing as the carriage is driven upward by activation of the pushbutton actuator.

6. The ligature-resistant liquid/gel dispenser of claim 1, wherein the at least one ramp comprises a pair of ramps disposed on either side of a central rear projection within the pushbutton actuator, and wherein the at least one forward and upward extension of the carriage comprises two corresponding pairs of extensions, wherein each of the pairs of extensions surrounds a corresponding wheel secured and rotationally coupled to the pair of extensions at a distal end thereof by an axle, wherein the wheels secured to each of the pairs of extensions roll along a corresponding one of the pair of ramps when the pushbutton actuator is activated.

7. The ligature-resistant liquid/gel dispenser of claim 6, wherein the carriage further comprises a pair of rear wheels rotationally coupled to the carriage at a rear of the carriage, wherein the pair of rear wheels roll upward along an inside surface of the rear housing as the carriage is driven upward by activation of the pushbutton actuator.

8. The ligature-resistant liquid/gel dispenser of claim 7, wherein the pair of rear wheels is a first pair of rear wheels located proximate a top of the rear of the carriage, wherein the carriage further comprises a second pair of rear wheels rotationally coupled to the carriage near a bottom of the carriage and displaced forward from the first pair of rear wheels, wherein the second pair of rear wheels roll upward along a projection of the rear housing extending in front of the second pair of rear wheels as the carriage is driven upward by activation of the pushbutton actuator, whereby the first pair of rear wheels and the second pair of rear wheels further secure the carriage against rotation when the pushbutton actuator is activated.

9. A method of dispensing a liquid or gel from a ligature-resistant liquid/gel dispenser, the method comprising:

mounting a rear housing of the liquid/gel dispenser to a wall by securing a mounting plane surface provided at a rear face of the rear housing;

opening a front cover rotatably attached to the rear housing, the front cover defining an aperture therethrough for receiving a pushbutton actuator;

installing a dispenser pump assembly including a reservoir for storing the liquid or gel in the ligature-resistant liquid/gel dispenser;

securing the front cover to the rear housing and over the reservoir and dispenser pump assembly with a locking mechanism; and dispensing the liquid or gel from the reservoir by pushing the pushbutton actuator to activate a pump mechanism of the dispenser pump assembly, wherein pushing the pushbutton actuator causes a carriage mounted in the rear housing to activate a vertical pump extension of the dispenser pump assembly, whereby vertical movement of the carriage activates a pump mechanism of the dispenser pump assembly, wherein the carriage is mechanically coupled to the pushbutton actuator when the front cover is secured, and wherein horizontal movement of the pushbutton actuator is translated into the vertical movement of the carriage, wherein the pushbutton actuator includes at least one inclined ramp, wherein the carriage includes at least one corresponding forward and upward extension inclined to extend along the at least one inclined ramp, so that when the pushbutton actuator is depressed, the at least one ramp moves the corresponding forward and upward extension upward to raise the carriage and activate the pump mechanism, wherein the carriage further comprises one or more wheels each rotationally coupled to a distal end of a corresponding one of the one or more forward and upward extension of the carriage, wherein the one or more wheels roll along a corresponding one of the at least one inclined ramp when the pushbutton actuator is activated.

10. The method of claim 9, wherein the carriage defines an open collar for accepting the vertical pump extension of the dispenser pump assembly and wherein the installing the dispenser pump assembly installs the vertical pump extension within the open collar.

11. The method of claim 9, further comprising preventing attachment of a ligature above or around the liquid/gel dispenser by providing the front cover with an exterior that is curved or inclined downward from an apex.

12. The method claim 11, wherein the front cover and the rear housing join at a blind seam extending around the apex of the top projection and along both sides of the rear housing to prevent insertion of a ligature.

13. The method of claim 9, wherein the carriage further comprises one or more rear wheels rotationally coupled to the carriage at a rear of the carriage, wherein the one or more rear wheels roll upward along an inside surface of the rear housing as the carriage is driven upward by the pressing of the pushbutton actuator.

14. The method of claim 9, wherein the at least one ramp comprises a pair of ramps disposed on either side of a central rear projection within the pushbutton actuator, and wherein the at least one forward and upward extension of the carriage comprises two corresponding pairs of extensions, wherein each of the pairs of extensions surrounds a corresponding wheel secured and rotationally coupled to the pair of extensions at a distal end thereof by an axle, wherein the wheels secured to each of the pairs of extensions roll along a corresponding one of the pair of ramps when the pushbutton actuator is activated.

15. The method of claim 14, wherein the carriage further comprises a pair of rear wheels rotationally coupled to the carriage at a rear of the carriage, wherein the pair of rear wheels roll upward along an inside surface of the rear housing as the carriage is driven upward when the pushbutton actuator is pressed.

16. The method of claim 15, wherein the pair of rear wheels is a first pair of rear wheels located proximate a top of the rear of the carriage, wherein the carriage further comprises a second pair of rear wheels rotationally coupled to the carriage near a bottom of the carriage and displaced forward from the first pair of rear wheels, wherein the second pair of rear wheels roll upward along a projection of the rear housing extending in front of the second pair of rear wheels as the carriage is driven upward by the pressing of the pushbutton actuator, whereby the first pair of rear wheels and the second pair of rear wheels further secure the carriage against rotation when the pushbutton actuator is activated.

* * * * *